US006983893B1

(12) United States Patent
Thoburn et al.

(10) Patent No.: US 6,983,893 B1
(45) Date of Patent: Jan. 10, 2006

(54) ARC METALIZING UNIT

(75) Inventors: John Thoburn, Las Vegas, NV (US); Roger Borowinski, Wayne, NJ (US); Joseph Cusenza, Montclair, NJ (US); William Mackay, Egg Harbor, NJ (US)

(73) Assignee: WJRJ, Las Vegas, NV (US)

( * ) Notice: Subject to any disclaimer, the term of this patent is extended or adjusted under 35 U.S.C. 154(b) by 226 days.

(21) Appl. No.: 10/424,012

(22) Filed: Apr. 25, 2003

(51) Int. Cl.
*B05B 1/24* (2006.01)

(52) U.S. Cl. ..... 239/83; 239/79; 239/81; 239/84; 239/290; 239/518; 219/76.14; 219/76.16

(58) Field of Classification Search ..... 239/79, 239/81, 83, 84, 290, 505, 507, 510, 518, 239/521; 219/76.14, 76.15, 76.16
See application file for complete search history.

(56) References Cited

U.S. PATENT DOCUMENTS

| | | | | |
|---|---|---|---|---|
| 2,920,001 | A | 1/1960 | Smith et al. | |
| 3,312,566 | A | 4/1967 | Winzeler et al. | |
| 4,416,421 | A | 11/1983 | Browning | |
| 4,593,856 | A | 6/1986 | Browning | |
| 4,720,044 | A | 1/1988 | Stemwedel, Jr. | |
| 4,763,826 | A | 8/1988 | Kulicke, Jr. et al. | |
| 5,932,293 | A | 8/1999 | Belashchenko et al. | |
| 5,935,458 | A * | 8/1999 | Trapani et al. | 239/84 |
| 5,964,405 | A | 10/1999 | Benary et al. | |
| 6,076,742 | A | 6/2000 | Benary | |
| 6,245,390 | B1 * | 6/2001 | Baranovski et al. | 219/76.14 |
| 6,390,389 | B1 | 5/2002 | Tudor et al. | |
| 6,663,013 | B1 * | 12/2003 | Vanden Heuvel et al. | 239/83 |

OTHER PUBLICATIONS

The ArcMaster 1400 brochure, http://www.homestead.com/aflame/files/ArcMaster1400.doc, 4 pages.

* cited by examiner

*Primary Examiner*—Steven J. Ganey
(74) *Attorney, Agent, or Firm*—Rob L. Phillips; Greenberg Traurig

(57) ABSTRACT

A microprocessor controlled arc metalizing unit includes a wire cassette and a drive mechanism cassette engaged in a separable manner. By disengaging the wire cassette and drive mechanism cassette, an operator has much greater control of the unit since the wire loaded wire cassette is fixed and the operator need only maneuver the lightweight drive mechanism cassette. To improve the safety of the arc metalizing unit, a "dead-man" switch acts to automatically shut down the arc metalizing unit should any number of preestablished safety conditions be breached. In addition, one or more composite housings enclose the operational components of the arc metalizing unit to improve safety. Reliability is improved through a tension control unit that eliminates any rotational fluctuations associated with wire spools. The arc metalizing unit further incorporates a touch pad control with a display for operating the unit and displaying the status of the unit.

18 Claims, 9 Drawing Sheets

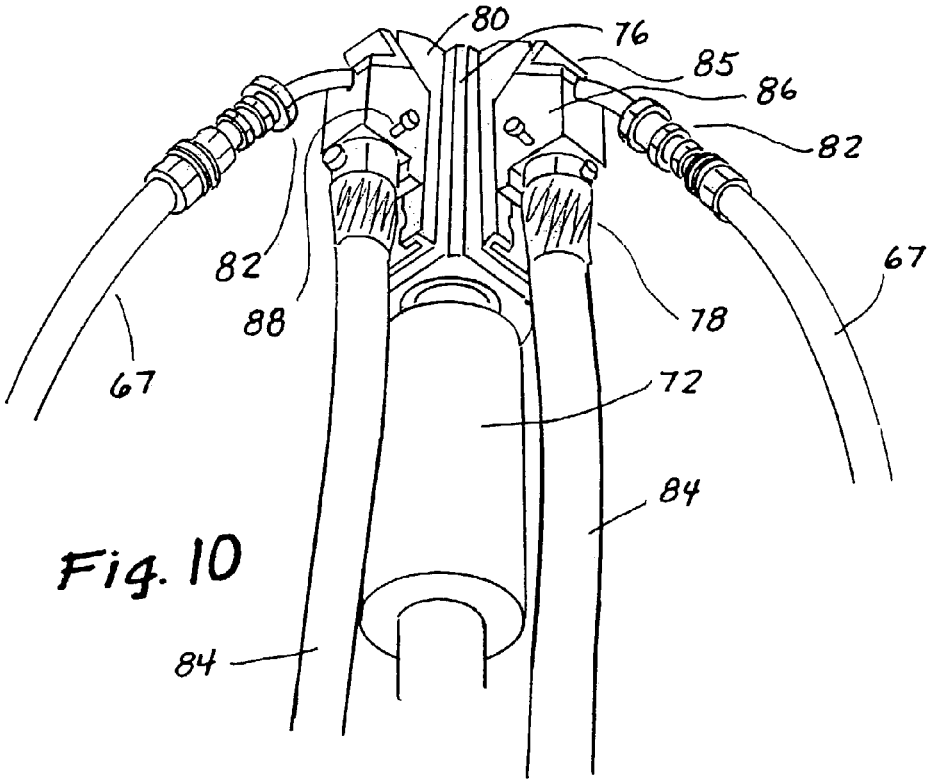
Fig. 10
Fig. 12
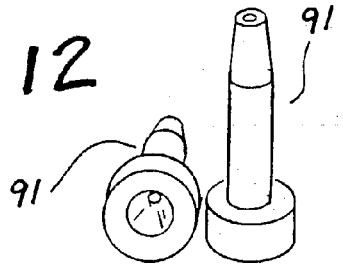
Fig. 11
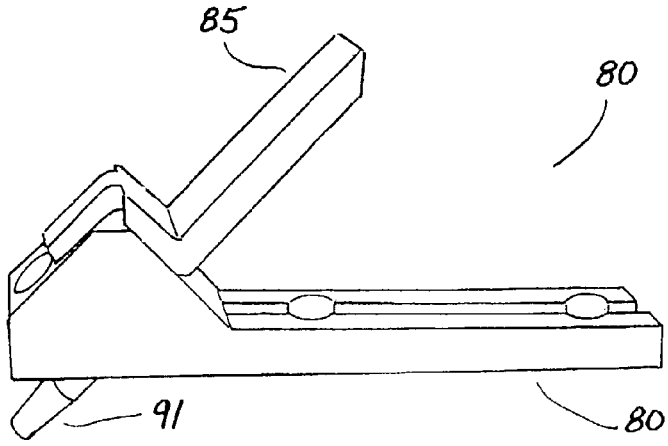

ARC METALIZING UNIT

FIELD OF THE INVENTION

The embodiments of the present invention relate generally to arc metalizing units. More particularly, an arc metalizing unit which incorporates several unique features, including at least a "dead-man" switch and light-weight, non-conductive composite casing(s), which improve the efficiency, ease of handling and overall safety of operating the arc metalizing unit.

BACKGROUND

The art of metalizing has been traditionally used to protect metallic surfaces from corrosion. The basic functions of an arc metalizing unit are to liquify a material, typically metal, and then to propel the molten material onto a subject surface. The applied metal coatings act to cathodically protect the surface from corrosion and erosion for up to 100 years.

Commonly, an arc metalizing unit operates by subjecting a pair of metal wires to an electric current and then directs the ends of the metal wires to a common point within an arc metalizing unit spray gun. Near, or at, the common point, an arc of electricity liquefies the wire ends. A powerful stream of gas focused at the common point atomizes the molten metal and propels the molten particles depositing them on a subject surface. The metal coating bonds to the subject surface then protects the surface from external elements.

Although issued U.S. patents protect many different features of arc metalizing units, several drawbacks of conventional arc metalizing units remain unaddressed. First, wire loaded arc metalizing units are heavy and cumbersome for operators to maneuver. Second, the use of large electric currents, high pressure air and molten metal creates an inherently dangerous unit. Third, the current metalizing units fail to operate properly when fitted with hard wire. These drawbacks and the ability to work in confined spaces are addressed by the embodiments of the unique arc metalizing unit disclosed herein.

SUMMARY

Accordingly, the embodiments of the present invention include a wire cassette and drive mechanism cassette engaged in a separable arrangement. Traditionally, an arc metalizing unit is a single unit which is heavy and cumbersome to maneuver. Much of the weight of the arc metalizing unit is attributable to the spools of metal wire being used to feed wire to the unit. Thus, by separating the wire cassette from the drive mechanism cassette, the arc metalizing unit becomes much easier to maneuver. The wire cassette and drive mechanism cassette are each supported by wheels for providing independent mobility of each cassette. Under the embodiments of the present invention, the drive mechanism cassette may be independently operated up to twenty feet or more from the wire cassette. In this manner, the metalizing spray gun can be utilized up to 35 feet or more from the drive mechanism thereby making the unit suitable for use in confined spaces or remote areas.

To eliminate the problem of wire unraveling, the wire cassette incorporates a wire spool support and a unique cam-lock device that prevents unwanted movement of the feed wires. Normally, the feed wire, particularly hard wire, has a tendency to unravel from its spool during operation of an arc metalizing unit. By providing a wire spool support, in communication with a tension control device, the tendency to unravel has been overcome. The wire spool support eliminates both "back-roll" and "over-roll" of the wire spool during the application of hard wire such as stainless steel. Moreover, a cam-lock positioned immediately prior to the wire exiting the wire cassette eliminates the potential for a loose wire to unravel from the spool.

Reliability and safety of the arc metalizing unit are improved by shrouding a drive motor with an insulated non-conductive composite cover to eliminate the potential of motor failure due to electrical arcing or dust contamination during operation of the arc metalizing unit. The non-conductive composite acts like a jacket that covers and insulates the drive motor.

Several features of the embodiments of the present invention overcome the safety concerns with respect to the inherently dangerous elements of arc metalizing units. A "dead-man" switch provides an automatic means for ceasing the operation of the arc metalizing unit should the operator become incapacitated or interfere with the path of the molten metal, high-pressure air stream or DC current. A second safety feature provides for the enclosure of both the wire cassette and drive mechanism cassette in non-conductive composites, which act like a jacket by covering and insulating the internal components, thereby eliminating operator contact with the high energy potential of the metalizing wire and power supply cables.

BRIEF DESCRIPTION OF THE DRAWINGS

FIG. 10 illustrates a top view of the spray gun;

FIG. 11 illustrates a spray gun carrier plate;

FIG. 12 illustrates a side and rear view of feed tips; and

DETAILED DESCRIPTION

Figure 1:
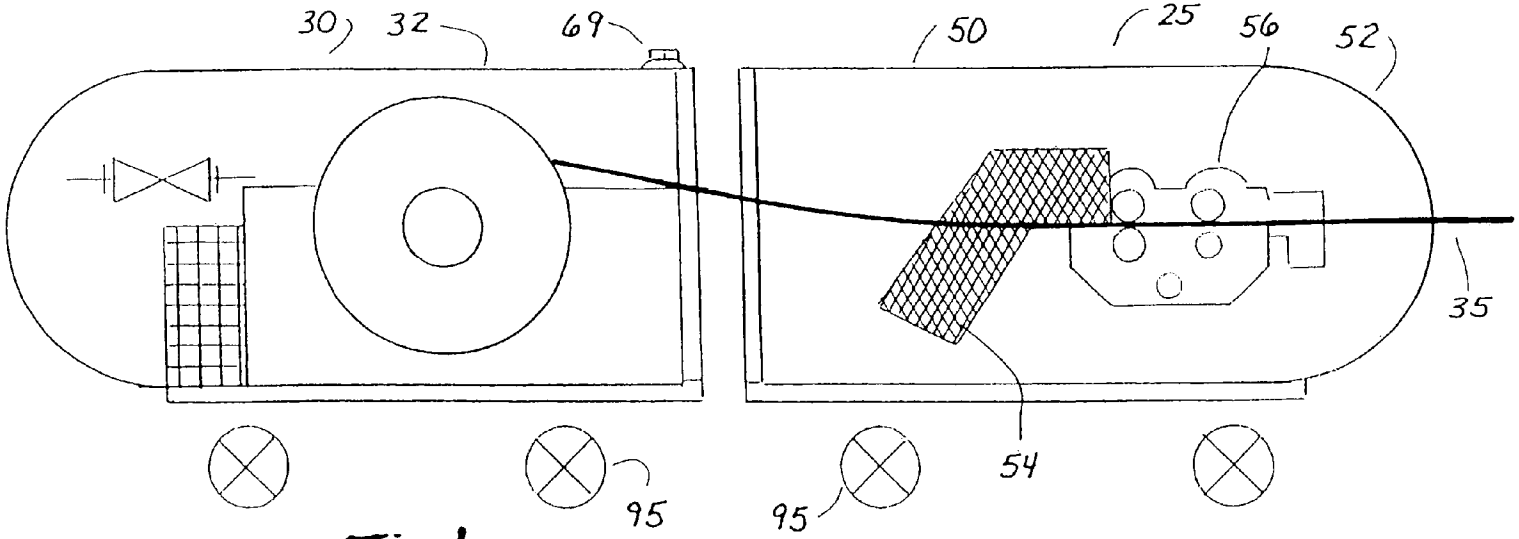
FIG. 1 illustrates a cross-sectional block diagram side view of an arc metalizing unit.

Reference is now made to the figures wherein like parts are referred to by like numerals throughout. FIG. 1 shows a cross-sectional block diagram side view of an arc metalizing unit generally denoted as reference numeral 25. A wire cassette 30, a drive mechanism cassette 50 and a spray gun 70 (not shown in FIG. 1) comprise the major components of the arc metalizing unit 25. Moreover, a source of compressed air and a power source provide the necessary compliment to the previously described components of the unit 25. It is noted that in practice the wire cassette 30 and drive mechanism cassette 50 may be fully enclosed by housings, but the drawings herein illustrate the housings as only partially enclosed for the sake of illustrating details of the present invention.

Figure 8:
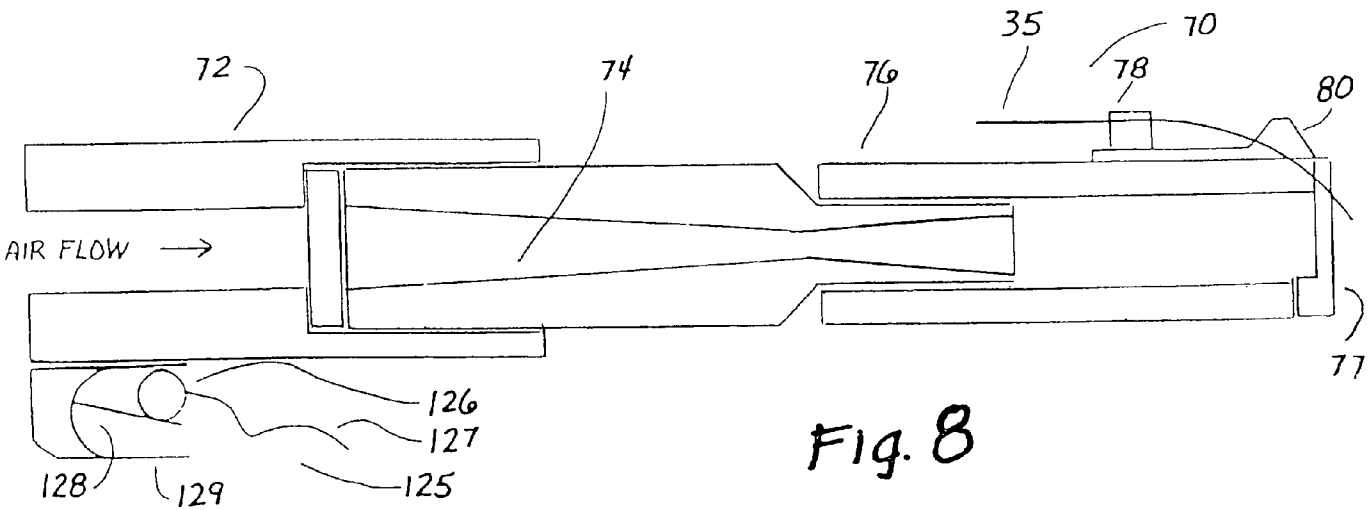
FIG. 8 illustrates a cross-sectional block diagram view of the spray gun.
Figure 4:
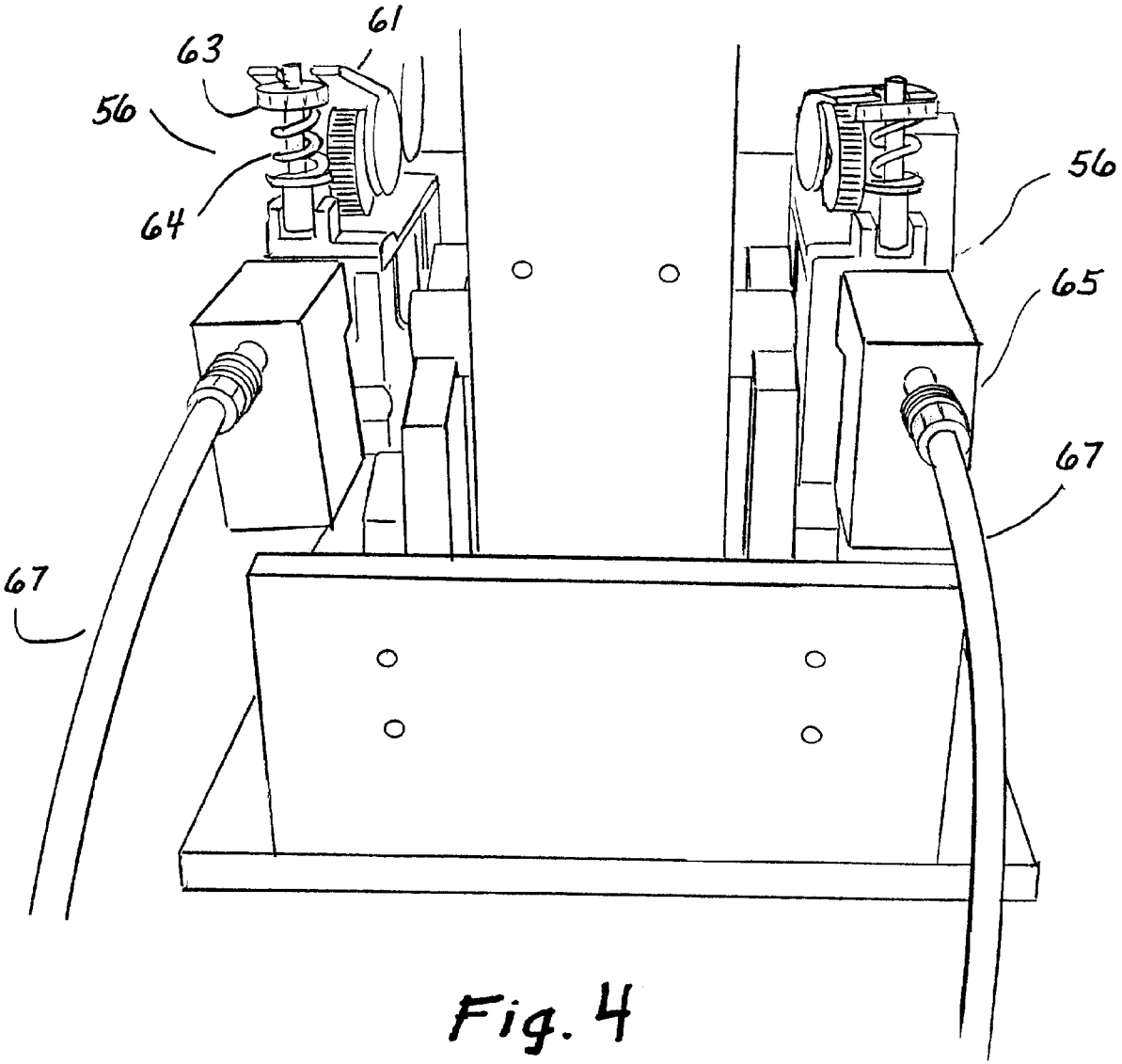
FIG. 4 illustrates a rear view of the dual wire drive mechanism.
Figure 5:
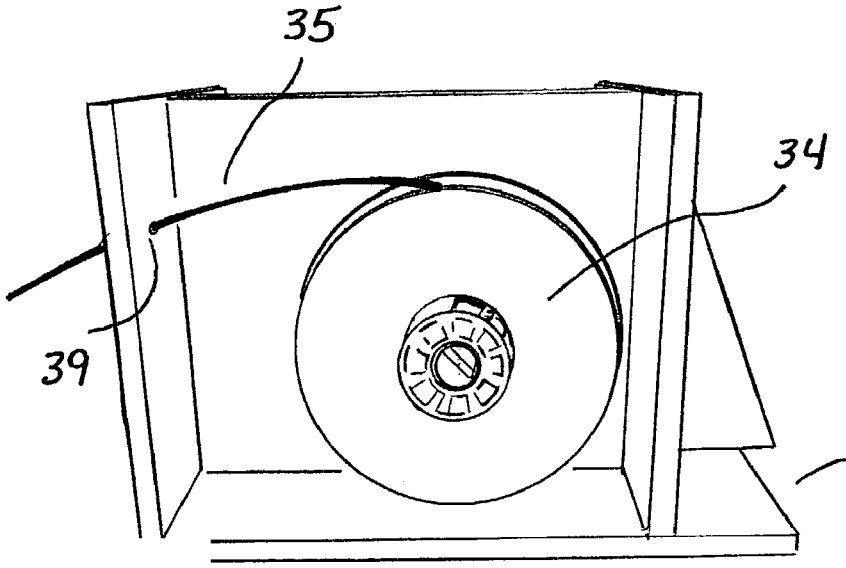
FIG. 5 illustrates a side view of a wire spool from which wire is pulled by the wire drive mechanism for guidance to a spray gun.
Figure 7:
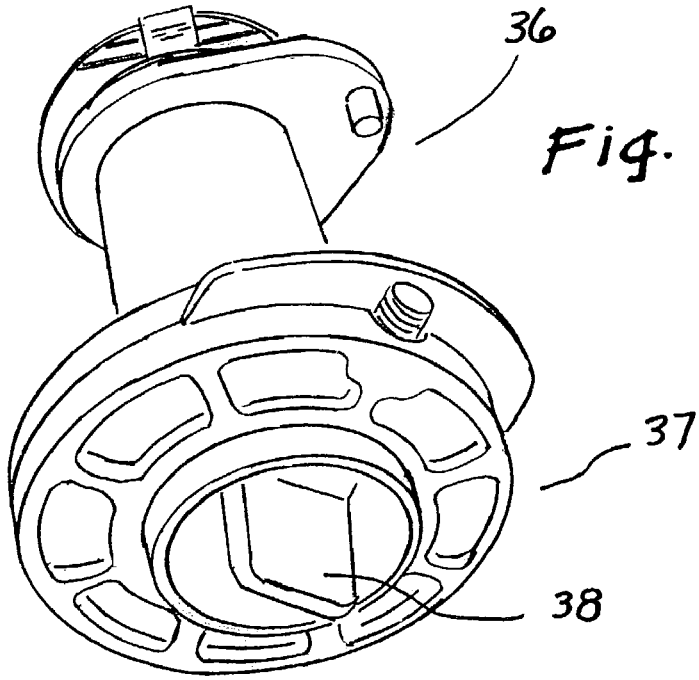
FIG. 7 illustrates a perspective view of a wire spool support and retaining clip.
Figure 6:
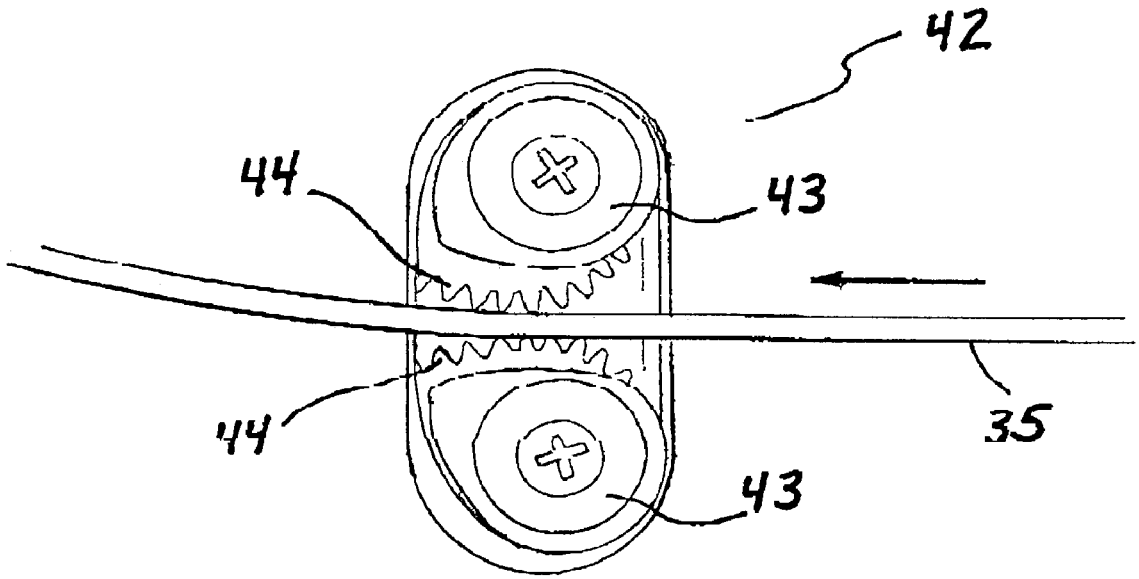
FIG. 6 illustrates a cam-lock device.
Figure 9:
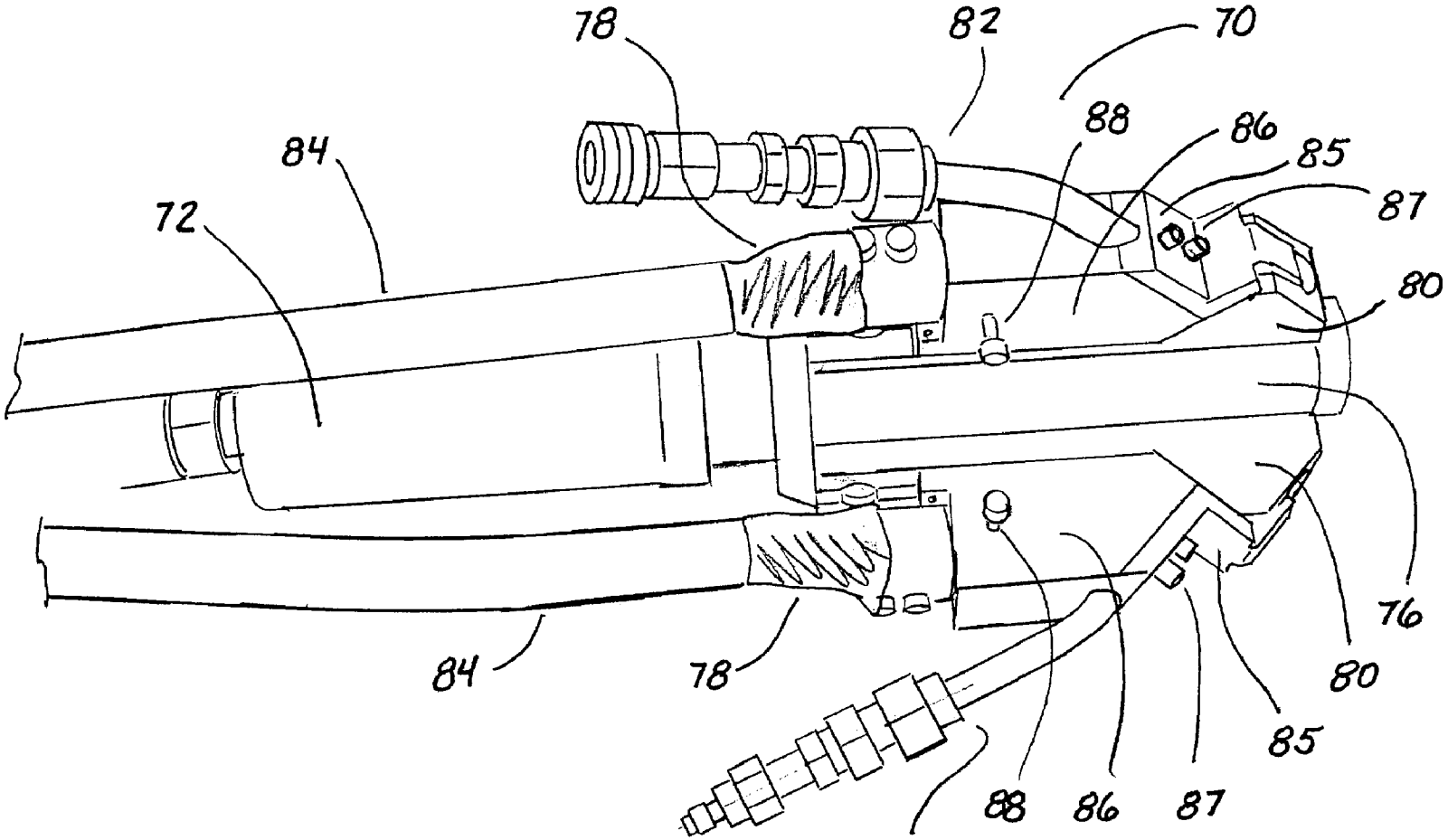
FIG. 9 illustrates a perspective view of the spray gun.

As shown in FIGS. 5–7, the wire cassette 30 includes a housing 32, two wire spools 34 (only one is shown) holding wire 35, a spool support 36 for each spool 34, a variable tension control device 38 for each spool 34 and a cam-lock device 42. As shown in FIGS. 1–4, the drive mechanism cassette 50 includes a housing 52, a drive motor 54 and two wire drives 56 (only one is shown). The wire cassette 30 and the drive mechanism cassette 50 are separate units such that they may move on wheels 95 as a single unit or may be disengaged to move independent of one another. The independent movement provides an operator with a great degree of versatility and mobility in difficult environments. As shown in FIGS. 8–10, the spray gun 70 includes an air coupling 72, an air venturi tube 74, a gun body 76, a power connection 78 and a carrier plate 80.

In practice, the wires 35 are pulled from each of the wire spools 34 by the powered wire drives 56 and guided to the spray gun 70. At specific points during their movement, the wires 35 are each subjected to opposite electrical charges by the electricity source. The two oppositely charged wires 35 are then guided to a common point within a spray gun nozzle 82. At, or near, the common point the electrically energized wires 35 create an arc of electricity that liquefies the ends of each wire 35. A stream of high pressure air then propels the liquified metal against a subject surface. Any metal, including zinc, aluminum, copper and stainless steel, which can be obtained in metal wire form can be liquified and sprayed using the embodiments of the present invention.

Figure 2:
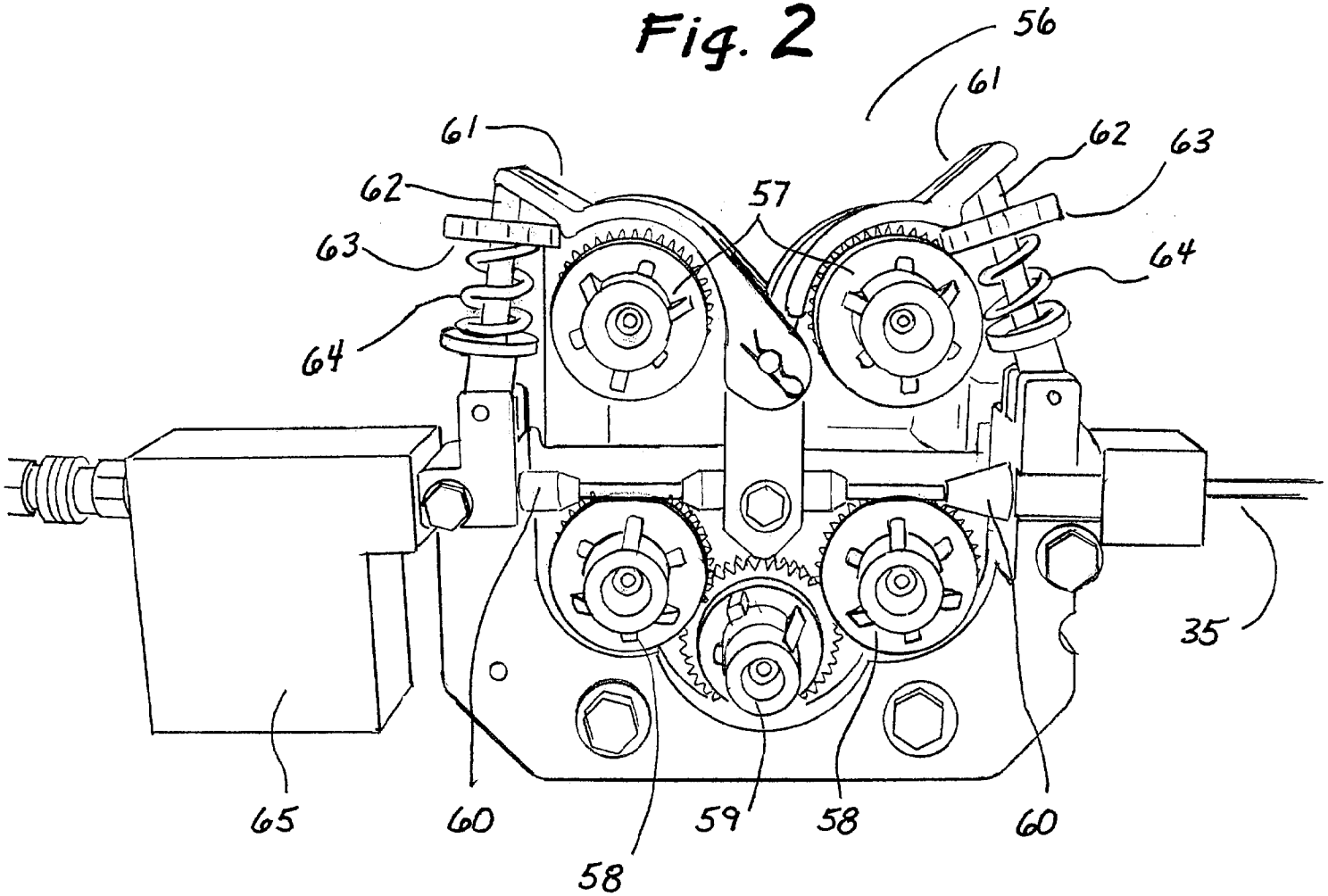
FIG. 2 illustrates a side view of a single wire drive an open position for accepting wire.

FIG. 2 illustrates a single wire drive 56 in an open position for receiving the wire 35. The wire drive 56 is powered by the motor 54 which acts to pull the wire 35 from its spool 34. The wire drive 56 is comprised of two upper gears 57 and two lower gears 58 driven by a single powered gear 59. The wire 35 passes through several wire guide tubes 60 designed to maintain the wire 35 in the proper orientation. Also shown in FIG. 2 are gear brackets 61, tension spring studs 62, tension adjust knobs 63 and tensions springs 64.

Figure 3:
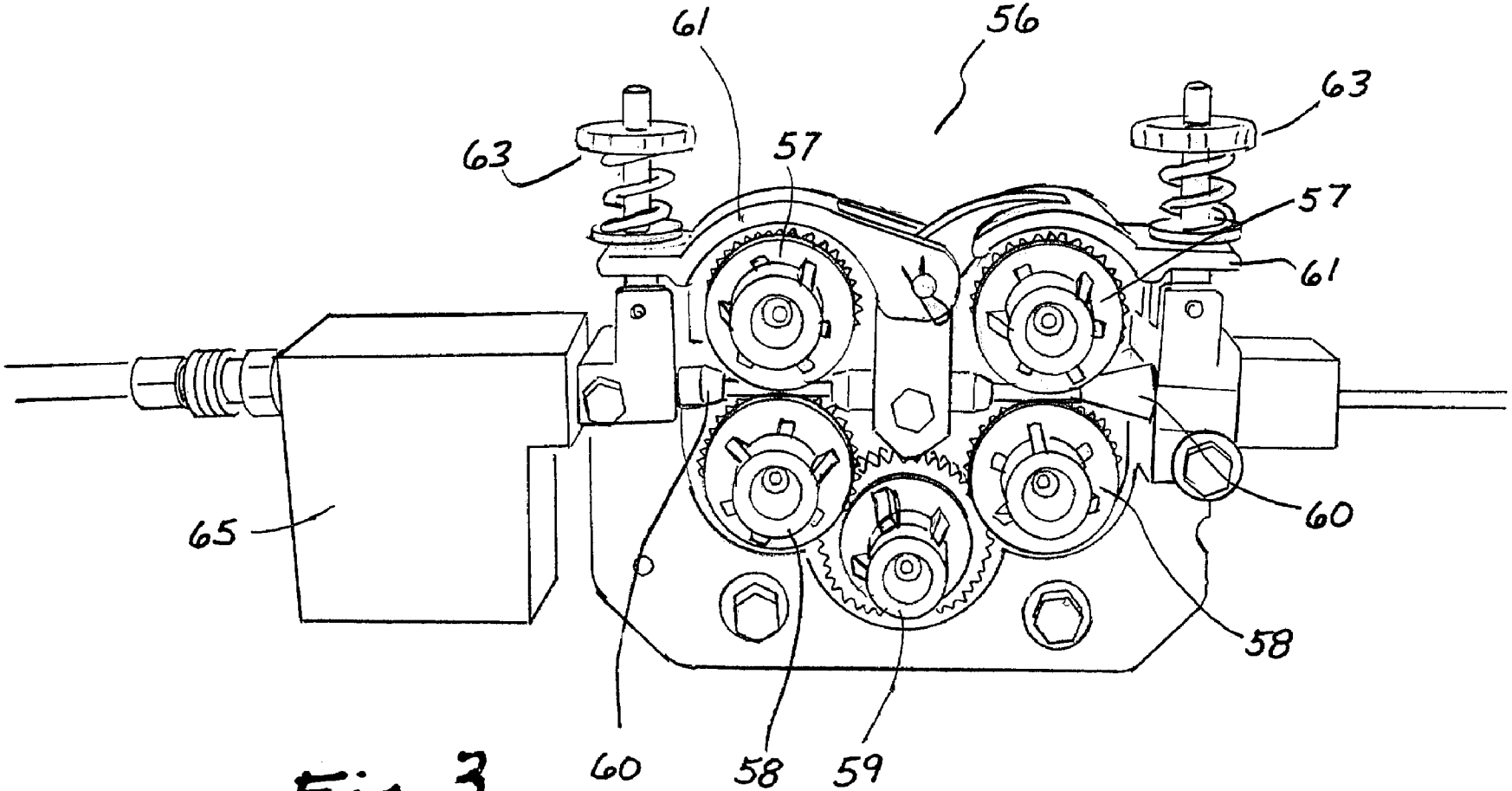
FIG. 3 illustrates a side view of the wire drive in a closed position to feed wire.

FIG. 3 illustrates the single wire dive 56 in a closed position. In the closed position the upper gears 57 are engaged with the corresponding lower gears 58 such that the driving gear 59 acts to drive the upper gears 57 and lower gears 58 in opposite directions thereby pulling the wire 35 from its spool 34. The wire drive 56 is closed by lowering the gear brackets 61 and locking them in place by tightening the tension adjust knobs 63. In this manner, the wire drive 56 is able to accept wire of any size.

Also shown in FIGS. 2 and 3 is a power coupling 65 which facilitates moving the wire 35 to the spray gun 70 and the wire guide tubes 60 ensure the wire 35 enters and exits the wire drive 56 in a stable and proper orientation.

Now referring to FIG. 4, a rear view of dual wire drives 56 illustrate a dual wire drive arrangement. The two wire drives 56 are symmetric and otherwise identical in design.

Figure 13:
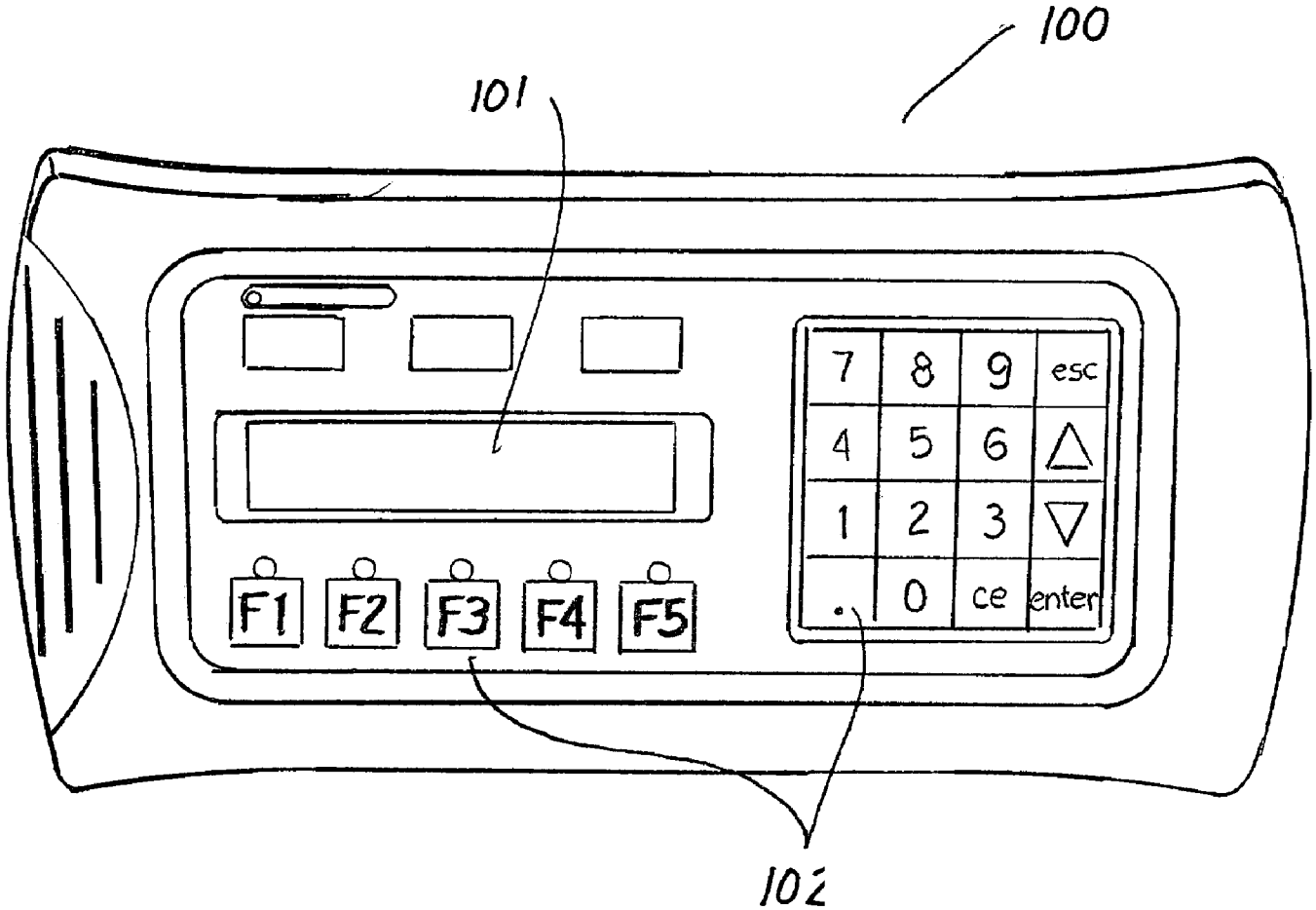
FIG. 13 illustrates a touch pad control unit.

A speed controller 69 (shown in FIG. 1) may reside proximate the drive mechanism cassette 50 and allows an operator to control the speed of the wire drives 56. Alternatively, the speed can be controlled by a touch pad control unit 100 (as shown in FIG. 13). The speed of the wire drives 56 is dependent on the nature of the particular application and the specific wire being used. For example, the use of hard wire may require that the speed of the wire drives 56 be reduced to allow the wire to be liquified adequately prior to being propelled onto a subject surface. Also, different surfaces may be more or less susceptible to coating than others such that the application speed of the metal must be increased or decreased, respectively.

FIG. 5 illustrates a spool 34 which maintains the wire 35 until it is pulled off the spool 34 by the wire drive 56. As shown in FIG. 7, a wire spool support 36 is designed to receive an opening of the spool 34. A retention clip 37 maintains the spool 34 in place on the support 36. The wire spool support 36 also incorporates a tension control device 38 for controlling the tension of the spool 34. Common spool fluctuations include "back-roll" and "over-roll" which can cause the wires 35 to unravel from the spool 34. The tension control device 38 acts as a positive spool lock to prevent any undesired forward and rearward spool rotation. In addition, the adjusted tension and drive motor 54 allow an operator to regulate the rate at which the spool 34 rotates thereby optimizing the operation of the arc metalizing unit 25. For example, light-weight wire may require more tension to prevent the spool 34 from rotating too quickly and thus preventing the wire 35 from uncontrollably unraveling from the spool 34.

Ideally, the housing 32 of the wire cassette 30 incorporates two apertures 39 for allowing the passage of the wire 35 from each spool 34. The apertures 39 should be of a size to generally control the wire 35 as it exits the housing 32 through the apertures 39. In other words, the apertures 39 should not be much larger than the diameter of the wire 35 being used. Of course, to be efficient the apertures 39 should be adequately sized to allow various standard-sized wires to be used with the same housing. As shown in FIG. 6, a cam-lock device 42 for placement adjacent each aperture 39 further provides a means for controlling the movement of the wire 35. The cam-lock device 42 comprises two separated gear-like members 43, having teeth 44, secured to a platform or a housing floor depending in the position of the apertures 39. The gear-like members 43 are designed to rotate in only one direction (clockwise as shown) thereby preventing the wire 35 passing therebetween from reversing direction. In addition, the teeth 44 act to control the speed of the passing wire 35 thereby preventing too much wire from being pulled from the spool 34.

As described above, in one embodiment the wire cassette 30 and drive mechanism cassette 50 can act independently thereby providing certain benefits. When loaded with spools of wire, the entire arc metalizing unit 25 may weigh in excess of one hundred and fifty pounds such that it can be cumbersome to maneuver between various field locations. By disengaging the wire cassette 30 from the drive mechanism cassette 50, an operator need only control the weight of the drive mechanism cassette 50 which accounts for approximately twenty-five pounds of the overall unit 25 weight. In this arrangement, the drive mechanism cassette 50 can be independently maneuvered while the bulky wire cassette 30 remains stationary.

FIG. 8 illustrates a cross-sectional block diagram view of the spray gun 70. The spray gun 70 includes an air coupling 72, an air venturi tube 74, a gun body 76, a power connection 78 and a carrier plate 80. Feed tips 91 (shown in FIG. 12) direct the two wires 35 into the spray gun body 76 so that the wires approach a common point so that the electric arc is created thereby facilitating the operation of the arc metalizing unit 25.

To increase the effectiveness of propelling the molten metal particles, the high-pressure air stream is passed through the air venturi tube 74 which increases the air velocity and causes the air move in a non-turbulent circular pattern. The circular pattern reduces the metallic dusting that can occur due to uncontrolled or turbulent air flow which is generated at, and which is exacerbated over distance, the air discharge point upstream of the wire common point.

The air venturi tube 74 operates by reducing the cross-sectional area of the air path over a predetermined length thereby increasing the speed of the air. Once the path has reached minimum cross-sectional area the path is widened to control the air flow. Upon exiting the air venturi tube 74, the air flows at a high speed in a controlled pattern thereby maximizing the effectiveness of the propelled molten metal particles. The increased air velocity causes the molten metal to be propelled onto the subject surface at an accelerated rate. The accelerated rate results in lower porosity and increased plasticity of the deposited metal. Moreover, the increased velocity results in shorter travel times for the molten particles thus improving the overall efficiency of the arc metalizing unit 25. More particularly, shorter travel times produce less dusting or overspray associated with cooling of the molten particles prior to their impact with the subject surface. The shorter travel times also enhance the appearance of the metalized surface while reducing the amount of coating material required to complete a full coating of the subject surface.

Another feature of the spray gun 70 illustrated in FIG. 8 is a removable deflector 77 implemented at an exit of the spray gun body 76. The deflector 77 re-directs the flow of the molten metal at a preestablished angle (e.g. 90 degrees) to allow the molten metal to reach irregular locations. For example, the deflector 77 is ideal for metalizing I-beams which have many surfaces at varying angles to one another. The deflector 77 is easily removed and installed in the field to provide a versatile unit 25.

Now referring to FIG. 9, a perspective view of the spray gun 70 shows the air coupling 72, the gun body 76, the power connection 78 and a carrier plate 80. Wire guides 82 direct each of the wires 35 to a common point within the gun body 76. A supply of high-pressure compressed air is attached to the gun body 76, namely the air coupling 72. While any gas may be used, air is the most readily available gas and it lends itself to the operation of the arc metalizing unit 25. The compressed air is directed through the air coupling 72, gun body 76 and the air venturi tube 74. Upon exiting the air venturi tube 74, the high pressure air then propels molten metal, created at the wire common point within the gun body 76, onto the subject surface. Power is provided to the spray gun 70 by the power cables 84. FIG. 9 shows a top view of the spray gun 70 with the non-conductive feed tubes 67 in place. The feed tubes 67 extend from each wire drive 56 to the spray gun 70.

FIG. 11 illustrates the carrier plate 80 having attached thereto a retainer arm 85 for supporting wire guides 82 and a power cable and wire guide carrier 86. As shown in FIGS. 8 and 9, the retainer arm 85 and wire guide carrier 86 act to secure the wire guides 82 in place. Screws 87 or the like are used to adjustably join the retainer arm 85 to the wire guide carrier 86. Similarly, one or more screws 88 or the like are used to retain the power cables 84 to the power cable and wire guide carrier 86.

FIG. 12 illustrates wire feed tips 91 which direct the wires 35 to the common point within the gun body 76. A single wire feed tip 91 is inserted under the retainer arm 85 of each carrier plate 80 such that the retainer arm 85 secures the feed tip 91 in a position generally adjacent to the gun body 76.

The use of electrical current, high pressure air flow and molten metal create an inherently dangerous machine. A "dead-man" switch 125 (shown in FIG. 8) incorporated on the spray gun 70 provides an automatic means for preventing safety mishaps. In a first embodiment, the "dead-man" switch 125 is activated by the relative position of an operator's hand, wrist or arm with respect to the spray gun 70. As shown, a ball 126 is attached to an operator's hand, wrist or arm via a tether 127. Should the distance between the spray gun 70 and the operator's body part become greater than the length of the tether, the ball 126 exits its position and allows a switch arm 128 to contact a conductive wall 129 thereby automatically shutting down the arc metalizing unit 25. Alternatively, the ball 126 completes an electric circuit such that upon the exit of ball 126 the circuit is open thereby shutting down the arc metalizing unit 25. In another alternative, the "dead-man" switch may be facilitated by an inserted key, pin, clip or other means in place of the ball 126.

The "dead-man" switch 125 allows an operator the necessary freedom of operation but automatically shuts down the arc metalizing unit should the operator's hand move too close to a danger zone (e.g. molten metal path), should the operator become incapacitated or should the spray gun 70 be dropped. The "dead-man" switch 125 also allows for the remote placement of the touch pad control unit 100. The remote location of the controls reduces the potential for failure or malfunction due to the harsh environment near the metalizing process.

The operation of the arc metalizing unit 25 is controlled by a processing unit (not shown) such as a microprocessor. The processing unit is in communication with the touch pad control unit 100 shown in FIG. 13 via electrical wiring (not shown). The touch pad unit 100 incorporates a display device 101 for displaying relevant information, including the state, of the arc metalizing unit 25 and touch controlled buttons 102 for allowing a user to enter commands or retrieve information. In practice, the touch pad control unit 100 may be implemented in any location on the arc metalizing unit 25, but ideally the control unit 100 is positioned remotely from the spray gun 70 to minimize damage to the control unit 100. For example, the control unit 100 may be positioned near the wire spools 34. The control unit 100 may control and display among other things, drive motor jog, air valve (open and close), machine start-up, machine speed, machine self-diagnosis, machine fault mode, daily and total operational hours, record operational hours for lease purposes and operational status. It is also contemplated that an operator will be able to control machine voltage settings as well. The list presented herein is not exhaustive and it is understood that the control unit 100 may be used to control and display any machine function and information, respectively.

Although the invention has been described in detail with reference to various embodiments, additional variations and modifications exist within the scope and spirit of the invention as described and defined in the following claims.

What is claimed is:

1. An arc metalizing unit comprising:

a wire retention unit housing one or more spools of wire whereby a rotational speed of said one or more spools of wire is controlled by a spool tension control device;

a wire drive unit having at least two adjustable wire drives for pulling two wires from the one or more spools of wire and forcing the two wires to a spray gun;

wherein said spray gun is in communication with an electrical energy source for oppositely charging each wire, said spray gun including wire guides for directing the oppositely charged wires to a common point within a spray gun body such that an electric arc between the charged wires is created thereby liquefying the wires; and wherein said spray gun is in further communication with a high pressure air source for propelling the liquified wire against a subject surface wherein the high pressure air is first passed through an air venturi tube within a body of the spray gun prior to the air propelling the liquified wire against the subject surface.

2. The arc metalizing unit of claim 1 wherein the wire retention unit and the wire drive unit are detachably engaged.

3. The arc metalizing unit of claim 2 wherein the wire retention unit and the wire drive unit are each supported by wheels such that the wire retention unit and the wire drive unit may be independently maneuvered.

4. The arc metalizing unit of claim 1 wherein an automatic switch for turning off the arc metalizing unit is incorporated on or adjacent the spray gun.

5. The arc metalizing unit of claim 4 wherein the automatic switch comprises a ball tethered to a unit operator's arm or hand such that if the distance between the ball and the operator's arm or hand exceeds a length of the tether, the ball is removed from contact with a switch causing the arc metalizing unit to turn off.

6. The arc metalizing unit of claim 1 wherein the wire retention unit and wire drive unit are each substantially enclosed in one or more non-conductive housings.

7. The arc metalizing unit of claim 1 wherein a deflector for changing the direction of the propelled liquified wire is incorporated near an exit of the spray gun.

8. The arc metalizing unit of claim 1 wherein the wire passes through a cam-lock device positioned adjacent the wire retention unit.

9. An arc metalizing unit for coating a subject surface with molten metal comprising:

a wire cassette retention unit for retaining two spools of wire controlled by a spool tension control device such that the wire is prevented from unraveling;

two wire drives remotely located from the wire cassette for pulling the wires from the two spools of wire and forcing the two wires to a spray gun remotely located from both the wire cassette and wire drives;

a electrical power source for oppositely charging the two wires; and said spray gun incorporating wire guides for guiding the received wires to a common point within a spray gun body such that the oppositely charged wires produce an electric arc which acts to melt at least the wire tips, said spray gun in communication with a source of high pressure air for propelling the molten wire onto a subject surface.

10. The arc metalizing unit of claim 9 wherein the high pressure air is first passed through an air venturi tube within a body of the spray gun prior to the air propelling the molten wire against the subject surface.

11. The arc metalizing unit of claim 9 wherein the wire cassette retention unit is detachably engaged to a wire drive unit which retains the wire drives.

12. The arc metalizing unit of claim 11 wherein the wire retention unit and the wire drive unit are each supported by wheels such that the wire retention unit and the wire drive unit may be independently maneuvered.

13. The arc metalizing unit of claim 9 wherein a switch incorporated on or adjacent the spray gun causes the arc metalizing unit to automatically shut down in response to the occurrence of certain pre-established conditions.

14. The arc metalizing unit of claim 9 wherein the wire cassette and wires drives are each substantially enclosed in one or more non-conductive housings.

15. The arc metalizing unit of claim 9 wherein a deflector for changing the direction of the propelled molten wire is incorporated near an exit of the spray gun.

16. The arc metalizing unit of claim 9 wherein the wire passes through a cam-lock device integrated near the wire cassette.

17. An arc metalizing unit comprising:

a wire retention unit having a non-conductive housing for retaining two spools of wire, a rotational speed of said two spools of wire being controlled by a spool tension control device;

a wire drive unit having at least two adjustable wire drives, said wire drives incorporating one or more sets of gears to facilitate pulling of two wires from the one or more spools of wire and compelling the two wires to a spray gun;

wherein said spray gun is in communication with an electrical energy source for oppositely charging each wire, said spray gun including wire guides for directing the oppositely charged wires to a common point within a spray gun body such that an electric arc between the charged wires is created thereby liquefying the wires;

wherein said spray gun is further in communication with a high pressure air source for propelling the liquified wire against a subject surface; and a means incorporated on or adjacent the spray gun for causing the arc metalizing unit to automatically shut down in response to the occurrence of certain pre-established conditions.

18. The arc metalizing unit of claim 17 wherein the wire passes through a cam-lock device positioned near the wire retention unit.

* * * * *